United States Patent [19]

Lee

[11] 3,983,934

[45] Oct. 5, 1976

[54] HEAT EXCHANGER

[75] Inventor: Conrad E. Lee, Mound, Minn.

[73] Assignee: Pako Corporation, Minneapolis, Minn.

[22] Filed: May 15, 1975

[21] Appl. No.: 577,832

[52] U.S. Cl. ..... 165/165; 354/299; 354/324; 165/170

[51] Int. Cl.[2] ..... F28F 3/02

[58] Field of Search ..... 165/141–143, 165/157, 164–167, 170, 66; 354/299 TC, 324

[56] References Cited

UNITED STATES PATENTS

| | | | |
|---|---|---|---|
| 1,966,133 | 7/1934 | Pieper | 165/164 |
| 2,782,008 | 2/1957 | Caughill | 165/166 |
| 3,444,926 | 5/1969 | Stalberg | 165/166 |
| 3,623,416 | 11/1971 | Anderberg | 354/324 |

*Primary Examiner*—Charles J. Myhre
*Assistant Examiner*—Theophil W. Streule, Jr.
*Attorney, Agent, or Firm*—John W. Adams

[57] ABSTRACT

This is a heat liquid exchanger unit particularly adapted for use with situations where the heating liquid is under low pressure gravity flow at a relatively slow flow rate and constitutes a pair of outer flow passages for the gravity flow heating liquid, which surround an inner replenisher liquid flow chamber through which liquid under controlled rate of flow passes so that the flow rate of the replenisher liquid is equalized with the flow rate of the discharge liquid, the panels between the outer passages and the inner chamber being of thin wall high heat transfer construction and being specifically formed to provide a torturous path for the liquid through the inner chamber, the outer chambers also have a series of spaced divider brackets forming a torturous path through the outer passages.

3 Claims, 3 Drawing Figures

HEAT EXCHANGER

It is a general object of this invention to provide a relatively compact and efficient heat exchange unit for use with two liquids having relatively low flow rates.

It is a more specific object of this invention to provide a thin walled panel type of heat exchange unit which is simply and easily constructed to afford maximum heat transfer efficiency and minimum manufacturing cost.

These and other objects and advantages of this invention will be apparent from the following description made in connection with the accompanying drawing wherein like reference characters refer to similar parts throughout the several views, and in which.

Figure 1:
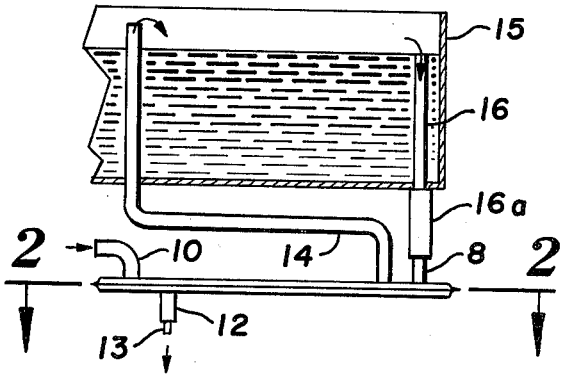
FIG. 1 is a side elevational view of the heat exchanger embodying your invention showing the same connected to a processing tank to replenish the liquid therein.
Figure 2:
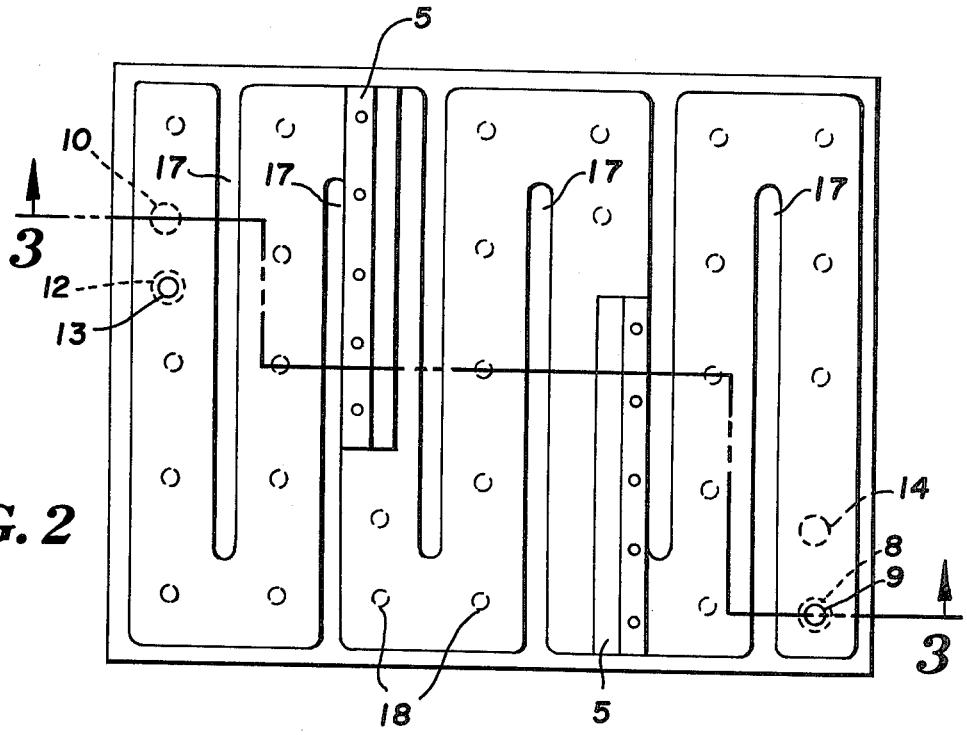
FIG. 2 is a top plan view of the invention.
Figure 3:
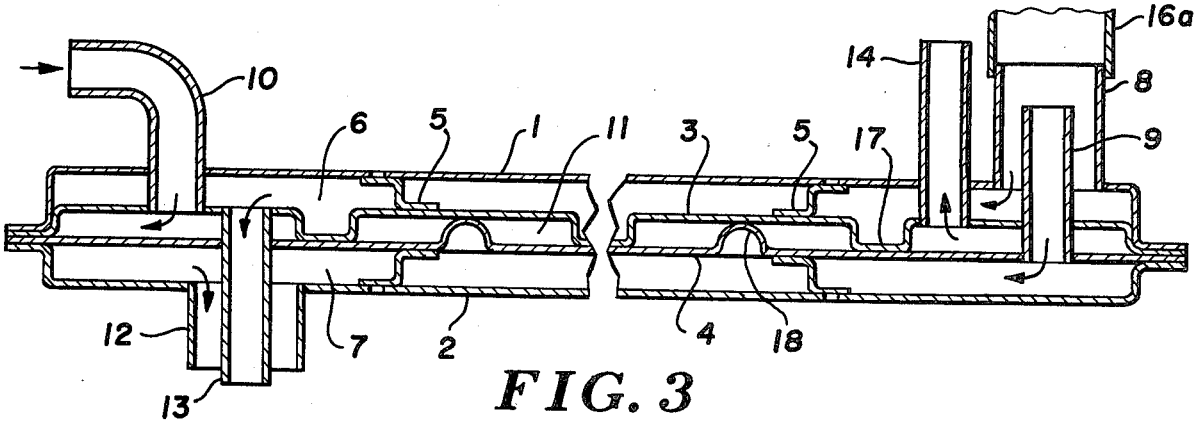
FIG. 3 is a vertical sectional view taken substantially along the line 3—3 of FIG. 2 and drawn to a somewhat larger scale.

This device is a heat exchange unit for liquids which is comprised of a pair of spaced apart imperforate outer housing panels 1 and 2 which enclose an inner sandwich section comprised of a pair of thin walled generally spaced apart heat exchange panels 3 and 4 which form a chamber 11. The perimeters of said outer panels 1 and 2 and said inner panels 3 and 4 are rigidly joined together and the panel 3 has depressed areas 17 formed therein so that when said panel 3 is joined with said panel 4, as by spot welding, a torturous flow path is formed through said inner chamber 11. Said panel 4 has spacer dimples 18 formed to maintain the spaced panel relation between said flow path areas. Said outer panels 1 and 2 are spaced outwardly from said inner sandwich section by means of a plurality of brackets 5 rigidly attached to said inner sandwich unit. Said outer panels 1 and 2 form upper and lower heat exchange passages 6 and 7 respectively, which surround said inner sandwich unit. The brackets 5 define a torturous flow path through said outer heat exchange passages 6 and 7.

An outer pipe 8 extends through said upper outer housing panel 1 and into said upper heat exchange passage 6, and an inner pipe 9 which is of a smaller outside diameter than said pipe is concentric therewith and extends through said outer panel 1 and also through said heat exchange panels 3 and 4 and into said lower heat exchange passage 7. A tube 10 extends through said outer housing panel 2 and heat exchange panel 4 forms the inlet means for said chamber 11.

An outer pipe 12 and a smaller concentrically arranged inner pipe 13 respectively form the outlet means for outer passages 6 and 7. The outer pipe 4 extends through said outer housing panel 2 and into said lower heat exchange passage 7, and an inner pipe 13 which extends through said outer housing panel 2 and also heat exchange panels 3 and 4, and thus into said upper heat exchange passage 6. A pipe 14 forms the outlet from chamber 11 and extends out through the heat exchange panel 3 and outer housing panel 1.

In typical operation, said passage inlet means are connected to a heated liquid bath processing tank 15 in photographic processing equipment, said tank requiring replenishment and temperature control of the processing liquid therein. Said heated liquid when it reaches a certain level in said tank 15 passes out through the overflow stand pipe 16 and enters both the inner and outer inlet tubes 8 and 9 respectively delivering to the upper and lower passages 6 and 7. Said liquid enters the upper and lower heat exchange passages 6 and 7 and transmits the heat energy of said heated liquid through said thin walled panels 3 and 4 and into the replenisher liquid flowing through said chamber 11. Said overflow liquid then flows out of said heat exchange unit to a drain through concentrically arranged outlet pipes 12 and 13 and is disposed of.

Unheated liquid enters said chamber 11 under pressure by means of said pipe 10 and is forced to flow along the torturous route defined in said chamber 11 by the depressed dividers 17. Heat energy transmitted through said heat exchanger panels 3 and 4 by said heated liquid is absorbed by said unheated liquid, thus causing said unheated liquid to approach a common temperature when the heated liquid, which will be of course lower than the original temperature of said heated liquid. Said liquid, heated by the exchange, passes through said chamber 12 and out through said pipe 14 and into said liquid bath processing tank 15.

It will of course be understood that various changes may be made in the form, details, arrangement and proportions of the parts without departing from the scope of this invention as set forth in the appended claims.

What is claimed is:

1. A heat exchanger and wash water tank assembly comprising a wash water processing tank in which the temperature of the water must be controlled, a heat exchanger to vary the temperature of the water being supplied to said tank and comprising a pair of thin walled generally spaced apart imperforate heat exchange panels forming an inner flow chamber, a pair of imperforate outer housing panels surrounding said inner panels in respectively outwardly spaced relation thereto to form outer heat exchange passages around said inner chamber, said heat exchanger panels having depressed areas formed to define a torturous flow path through said inner flow chamber, means spacing said outer housing panels respectively outwardly from said inner heat exchange panels to form torturous flow paths through said outer heat exchange passages, a fresh water supply conduit connected at one end of said inner chamber flow path, a fresh water outlet connected at the other end of said inner flow path, affording liquid flow circulation through said chamber flow path and delivering temperature modified fresh water to said tank, passage inlet means at one end of both outer passage heat exchange flow paths, an overflow conduit in said tank and connected to said passage inlet means to supply heat exchange water thereto, passage outlet means at the other ends of said heat exchange flow paths affording liquid flow circulation through said chamber.

2. The structure set forth in claim 1 wherein the inner panels are closely spaced apart to form a compact inner heat exchange sandwich and the outer panels are also closely spaced outwardly of said inner sandwich to form a flat compact heat exchanger adapted to be positioned in close association to said liquid tank into which the liquid from said heat exchanger is delivered and from which the liquid used as the heat exchange medium is withdrawn.

3. Dependent on claim 2 wherein the inlet means to the two outer passages constitute a pair of concentrically arranged conduits to divide the flow of the heat exchange water, one delivering to one outer flow passage and the other conduit delivering to the other outer flow passage.

* * * * *